United States Patent [19]

Wickenberg et al.

[11] 4,093,334

[45] June 6, 1978

[54] WIRE RETAINER

[75] Inventors: Ralph F. Wickenberg; Donald F. Miller; Lyle R. Anderson, all of St. Paul, Minn.

[73] Assignee: Minnesota Mining and Manufacturing Company, St. Paul, Minn.

[21] Appl. No.: 814,024

[22] Filed: Jul. 8, 1977

[51] Int. Cl.[2] ..... H01R 13/58

[52] U.S. Cl. ..... 339/107; 339/99 R; 339/103 R; 339/176 MF

[58] Field of Search ..... 339/107, 103 R, 103 M, 339/99 R, 176 MF, 210

[56] References Cited

U.S. PATENT DOCUMENTS

| | | | |
|---|---|---|---|
| 3,708,779 | 1/1973 | Enright et al. | 339/99 R |
| 3,873,173 | 3/1975 | Anhalt | 339/99 R X |
| 3,963,319 | 6/1976 | Schumacher et al. | 339/99 R X |

*Primary Examiner*—Roy Lake
*Assistant Examiner*—DeWalden W. Jones
*Attorney, Agent, or Firm*—Cruzan Alexander; Donald M. Sell; John C. Barnes

[57] ABSTRACT

A wire retainer is provided to pre-connectorize and position individual wires from a communications cable over a base member of a modular splice connector to facilitate the formation of a modular solderless splice. Provision is also made within the body member of the retainer for conductive probe testing of the individual wires of the communication cable.

5 Claims, 4 Drawing Figures

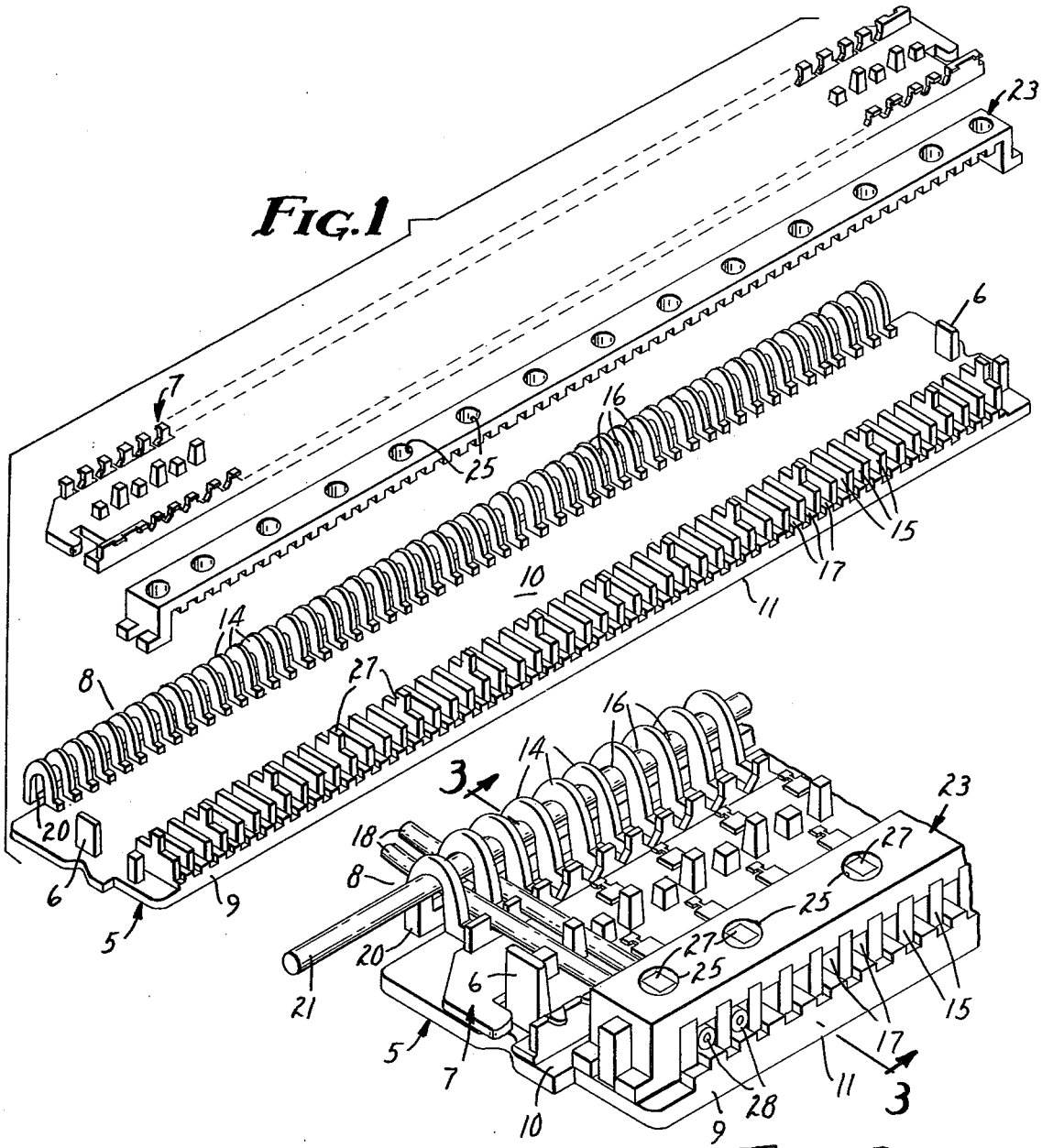
FIG. 1
FIG. 2
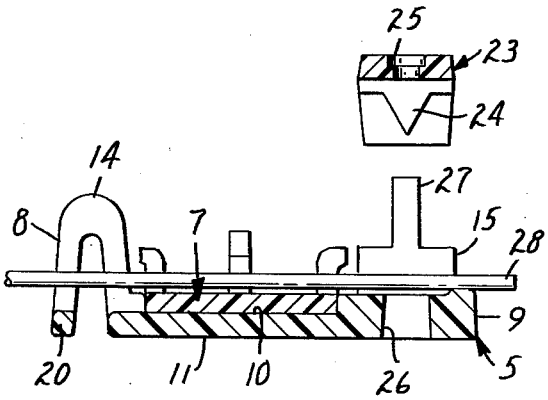
FIG. 3
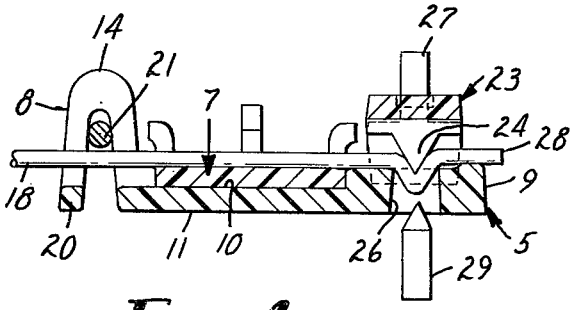
FIG. 4

WIRE RETAINER

BACKGROUND OF THE INVENTION

1. Field of the Invention

This invention relates generally to the splicing of communication cables, and in particular relates to a wire retaining device, useful for positioning individual wires from a multi-stranded communication cable in separated predetermined position over a modular splicing connector base member. Such modular splice connectors are known in the art from U.S. Pat. No. 3,708,779 to D. J. Enright et al assigned to Minnesota Mining and Manufacturing Company.

2. Description of the Prior Art

In the communication industry, it is desirable to inspect and test multi-wire communication cable before it is sent out into the field for assembly into a communication network. This result can be achieved by pre-terminating or pre-connectorizing the cable ends which permits cable testing in the cable factory or warehouse. In the field, these terminated ends can be joined to produce the completed cable-splice assembly.

Applicants' invention provides a means for achieving desirable pre-connectorizing and testing of communication cables while providing a means for subsequent modular splice assembly in the field.

SUMMARY OF THE INVENTION

The object of this invention is to provide means for pre-connectorizing a length of telecommunication cable in a fashion which permits both testing and rapid field splicing of the cable.

The retainer device consists of an elongate rectangular body member made from an insulating material such as a thermoplastic resin. This rectangular body member has a planar channel with alignment posts at each end. The base of a modular splicing connector is placed over the alignment post, thus positioning it in the channel.

The body member has a series of spaced projections, such as loop structures, which are formed along the back edge of the upperside of the body member. These projections separate and align the wires of the cable as they are laid in the wire retaining channels defined by the spaced projections. A complimentary series of spaced projections are located along the front edge of the upper surface of the body member. These projections which may be rectangular in shape define wire crimping channels. In operation, isolated, individual wires of the communication cable are laid transversely across the body member and lie in the wire retaining channels defined by the spaced projection or loop structures on the back edge of the body member and in the wire crimping channels defined by the spaced projections on the front edge of the body member.

A series of cap retaining anchor posts may be provided on the rectangular elements which form the wire crimping channels to align and anchor a cap member which is placed in mating relationship over the wire crimping channels.

In every wire crimping channel there is a strain relief recess. This recess provides the space into which an individual wire is forced when the cap member is installed. This recess may extend completely through the body member to form a test access hole connecting the upper and lower surfaces of the body member. This hole, which may be rectangular in shape, provides an access port for electrical conductive test probes that may be inserted into the crimping fixture to contact the individual wires through the lower surface of the body member.

During assembly, the cap member is pressed down onto the body. The anchor posts assist in the alignment of the cap member over the body member. Triangular shaped wire pushers formed in the cap member are located over the access holes in the body member. These pushers bend and force a short section of each wire into the access hole to mechanically lock the wire between the cap member and the retainer body member. The anchor posts which extend through cooperative holes in the cap member after the cap is mated to the body member, are cold-staked during the assembly process. This cold-staking process deforms the anchor posts into engagement with the holes of the cap member, thus securing the cap member to the body member.

To prevent these anchored wires from lifting out of the spaced projections on the front side of the retainer body during storage or while the cable is being handled, a strand of wire is inserted through these spaced projections which secure the strands of communication wire in the retaining channels.

BRIEF DESCRIPTION OF THE DRAWING

FIG. 1 is an exploded perspective view of the wire retainer body and crimping cap forming the wire retainer of the present invention with a splicing module base shown located over the body member.

FIG. 2 is a perspective view of a fully assembled wire retainer. In the interest of clarity, only two of a multiplicity of telecommunication wires are shown assembled into the retainer.

FIG. 3 is a vertical sectional exploded view of the body and the crimping caps taken along section 3—3 of FIG. 2. This shows a cap member, wire and base member in the unassembled state.

FIG. 4 is a vertical sectional view along section 3—3 of FIG. 2. This figure shows a wire secured in an assembled retainer member.

DESCRIPTION OF THE PREFERRED EMBODIMENT

The retainer body member as shown and described is adapted to splice 25 pairs of wires from a communication cable. This number is a standard of the U.S. communication industry; however, it is clear that the device according to this invention can be adapted to other cable standards.

The wire retainer body 5 has an elongated planar channel. The splicing module base 7 is aligned in this channel by alignment posts 6 on the body which cooperate with openings in the ends of the base. The back or wire receiving edge 8 of the retainer body has a multiplicity of spaced projections shown as wire retaining loops 14 formed along the upper surface of this edge. These loops coact with spaced projections shown as rectangular members 15 formed along the front edge 9 or crimping area of the body member to define wire channels which accept the telecommunication wires 18 as shown in FIG. 2.

In FIG. 2 the wire retainer is shown in the completely assembled configuration. A pair of telecommunication wires 18 have been placed transversely across the body member 5 and the cap member 23 has been cold-staked into position, thus securing the telecommunication wires to the body member.

Spaced projections shown as loop structures 14 are shown in cross-section on FIG. 3. Each loop structure consists of an arch shaped member, one end of which is anchored at the back edge 8 of the upper surface of the body member 5. The other end of the arch shaped member is attached to a bar structure 20, which runs parallel to and in the plane of the body member. Successive arch shaped members provide wire retaining channels 16 which receive the individual wires from the multi-stranded cable. These individual wires 18 are laid transversely across the body member as shown in FIG. 3.

When assembly is completed, a length of wire 21 (FIG. 4) is inserted through the loop structures lengthwise with respect to the body member 14 to prevent telecommunication wires 18 from lifting away from the retainer body member 5. This retaining wire 21 traps both the aligned telecommunication wires and the base member of the modular splice. Although the spaced projections which define these wire retention channels have been shown and described as loop structures, other topologically equivalent structures may be used.

The crimping action of the cap member is shown sequentially in FIGS. 3 and 4. An individual wire 18 from a cable is placed transversely across the wire retainer body member in channels defined by the loop structures 14 on the back edge of the body and the spaced rectangular projections 15 on the front edge of the body. The cap member 23 has individual triangular pusher members 24 which are positioned to align one directly over each access hole 26. When this cap member is pressed down over the anchor posts 27, wires 18 are forced to enter access holes 26. When the cap member is fully seated, the anchor posts 27 which extend above the surface of the cap member 23 are cold-staked to prevent the cap from moving. This process deforms the anchor posts and causes them to tightly engage the holes in the cap member. During the crimping and staking operation, the wire end 28 is sliced off by a cut-off knife before the cap member is fully seated. This sequence allows the final travel of the cap member to withdraw the free end of wire 18 slightly under the edge of cap member 23, as the wire is deformed into the access hole.

In summary, a typical assembly sequence would include locating the body member in the splicing head of a hydraulic or pneumatic splicing machine. Next, a base portion of a modular splicing connector would be laid in place in the center channel of the body member. Then pairs of wires from a telecommunication cable would be isolated and laid across the retainer base utilizing standard wire handling procedures. The cap member would then be placed over the extended anchor posts and a hydraulic or pneumatic crimping tool would engage in a three-stage action to complete the assembly of the unit. The crimping tool will have means for slicing off the free ends of the wires which extend out of the wire channels at front edge 9 of the body member. The tool will also have provision for cold-staking the anchor posts extending through the cap member. As the crimping tool is activated, contact is first made between the wire cut-off blade and an individual wire which lies in the wire channel. As the cut-off blade contacts a wire, the cap is pressed down to slightly displace the wire into the access holes. Typically, the cut-off tool will completely sever the wire before the crimping cap is completely seated.

After the wire is severed, continued motion of the crimping tool causes the crimping cap to be completely seated. During this seating action, the triangular shaped wire pushers 24 on the cap member 23 bend each wire 18 and force it into the test access hole 26 in the body member 5. This action deforms the wire and its insulation, physically locking and binding the wire end in place.

If electrical testing is desired, a sharp insulation piercing conductive probe device 29 can be inserted in the base assembly fixture and will make electrical contact with the wires through the access hole. Such conduction probe assemblies are known in the art from U.S. Pat. No. 3,699,501 to Enright et al, assigned to Minnesota Mining and Manufacturing Company, the assignee of this invention. The conductive probe assembly may pierce the insulation of the wire located in the access hole before or after the wire is cut off. If conductive probe testing is accomplished before the wires are severed, then the assembly process can be halted and corrective measures taken before the wires are severed.

The triangular shape of the pusher will withdraw the cut end of the wire from the cut-off blade during the crimping cap seating phase. This will electrically isolate this wire for test purposes. However, to ensure positive electrical isolation from the cut-off blade, it is desirable to coat the surface of the cut-off blade with a wear-resistant and non-conductive coating such as aluminum oxide or zirconium oxide. The final phase of the crimping operation is cold-staking of the anchor posts 27 which extend beyond the upper surface of crimping cap 23 through alignment holes 25. When the cap is completely seated and cold-staked into position, the body member and its associated cable will be removed from the crimping tool. The final assembly operation consists of insertion of a length of wire 21 through the retaining loops 14 of the body member to prevent the telecommunication wires 18 from lifting out of the front end of the body, and thus to trap the splicing module base 7 in the planar channel of the body member.

The fully completed retainer assemblies are covered for protection during storage and shipment. When the completed assembly is used in the field, the protective cover is removed and the retainer body placed in a portable splicing unit. The field splicing operation mates telecommunicaton wires 18 with the corresponding wire pairs of the complimentary cable assembly. The splicing operation mates the modular splice base portion located in the retainer body with a splice module on an adjoining cable. This operation cuts the telecommunication wires 18 free from the retainer assembly which is then removed by withdrawing wire 21 from the retaining loops 14. The body member which carries the punctured and severed wires is removed from the completed splice and discarded.

We claim:

1. A device for separating and positioning individual wires of a multiple conductor cable in a fixed relationship over the base element of a splice connector comprising:

an elongate insulative body member adapted to receive a base element of a splice connector and isolated wires from a multi-conductor cable, said body member having an upper and lower surface and a first and second edge on said upper surface, and an insulative cap member formed to mate with said body member, said body member having a plurality of spaced projections on said upper surface and positioned along said first and second edge to define a plurality of parallel transverse aligned wire receiving channels along said edges for receiving and holding said individual wires in substantially parallel alignment, said body member having a plurality of strain relief recesses formed in said upper surface of said body member and located within said wire channels along said first edge, said body member and said cap member having a plurality of alignment means for aligning said cap member with said body member, said cap member having spaced wire pusher means aligned with said access holes to cooperate with said access holes for bending and binding said individual wires at said access holes, and retaining means for securing said cap member on said body member.

2. The device of claim 1 wherein said strain relief recesses extend through said body member connecting said upper surface of said body member with said lower surface of said body member, defining a plurality of test access holes therein.

3. The device of claim 1, wherein said spaced projections along the second edge of the body member comprises:

a bar member spaced in coplanar parallel relationship with said second edge of said body member, a plurality of arch-shaped structures affixed to and extending upwardly from said back edge of said upper surface of said body member, extending toward and attached to said bar member.

4. The device of claim 1 wherein said spaced projections along the first edge of the body member comprise a plurality of rectangular projections.

5. The device of claim 4 wherein the retaining means for securing said cap member on said body member comprises:

a plurality of anchor posts formed on said rectangular shaped projections for aligning and securing said cap member to said body member, said cap member having an upper and lower surface and a plurality of holes in cooperative arrangement with said anchor posts, which extend through said cap member, said anchor post being deformable, to tightly engage said holes and secure said cap member to said body member.

* * * * *

UNITED STATES PATENT AND TRADEMARK OFFICE

CERTIFICATE OF CORRECTION

PATENT NO. : 4,093,334

DATED : June 6, 1978

INVENTOR(S) : Ralph F. Wickenberg; Donald F. Miller; Lyle R. Anderson, all of St. Paul, Minnesota.

It is certified that error appears in the above-identified patent and that said Letters Patent are hereby corrected as shown below:

In Claim 1:

In column 5, at line 16, delete "access holes" and substitute therefor --recesses--;

In column 5, at line 17, delete "access holes" and substitute therefor --recesses--; and In column 5, at line 18, delete "access holes" and substitute therefor --recesses--.

Signed and Sealed this

*Tenth* Day of *March 1981*

[SEAL]

*Attest:*

RENE D. TEGTMEYER

*Attesting Officer*

*Acting Commissioner of Patents and Trademarks*